US005542263A

United States Patent [19]

Choi et al.

[11] Patent Number: 5,542,263

[45] Date of Patent: Aug. 6, 1996

[54] WINDOW MOUNTED AIR CONDITIONER

[75] Inventors: Heung S. Choi; Ju Y. Jeong; Jae A. Kim, all of Suwon, all of Rep. of Korea

[73] Assignee: Samsung Electronics Co., Ltd., Suwon, Rep. of Korea

[21] Appl. No.: 293,947

[22] Filed: Aug. 24, 1994

[30] Foreign Application Priority Data

| | | | |
|---|---|---|---|
| Aug. 26, 1993 | [KR] | Rep. of Korea | UM93-16677 |
| Dec. 17, 1993 | [KR] | Rep. of Korea | UM93-28341 |
| Dec. 17, 1993 | [KR] | Rep. of Korea | UM93-28342 |
| Dec. 17, 1993 | [KR] | Rep. of Korea | UM-28349 |

[51] Int. Cl.[6] ..... F25D 23/12

[52] U.S. Cl. ..... 62/262; 62/412

[58] Field of Search ..... 62/262, 404, 407, 62/426, 411, 412, 414, 419

[56] References Cited

U.S. PATENT DOCUMENTS

| | | | |
|---|---|---|---|
| 3,200,608 | 8/1965 | Glickman | 62/262 |
| 3,477,211 | 11/1969 | Peitsch | 62/262 |
| 4,505,129 | 3/1985 | Yamane et al. | 62/262 |

*Primary Examiner*—John M. Sollecito

*Attorney, Agent, or Firm*—Burns, Doane, Swecker & Mathis, L.L.P.

[57] ABSTRACT

A window air conditioner includes indoor and outdoor portions separated by a partition. Air intake ports are formed in front and rear panels of the indoor portion. An L-shaped evaporator extends across both intake ports. An indoor sirocco fan rotatable about a vertical axis draws air through the evaporator and directs the air toward an air discharge port formed in the front panel. A filter has two filter sections connected to a common connecting element so as to be insertable simultaneously across the air intake ports of the front and side panels. The outdoor portion includes air intake ports formed in both side panels and air discharge ports formed in a rear panel and one of the side panels. An L-shaped condenser extends across both discharge ports. An outdoor sirocco fan rotatable about a horizontal axis is arranged to direct air toward the condenser. Two propeller blades are rotatable coaxially with the outdoor sirocco fan adjacent opposite ends thereof for directing air toward the outdoor sirocco fan.

4 Claims, 6 Drawing Sheets

FIG. 6
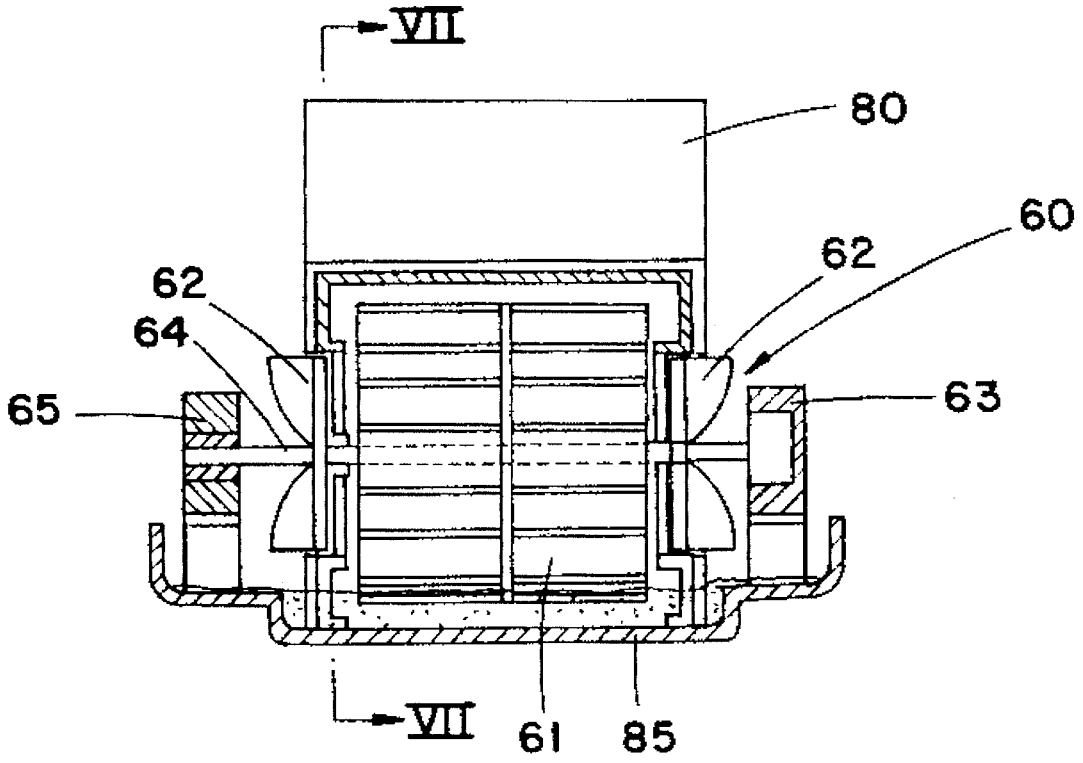
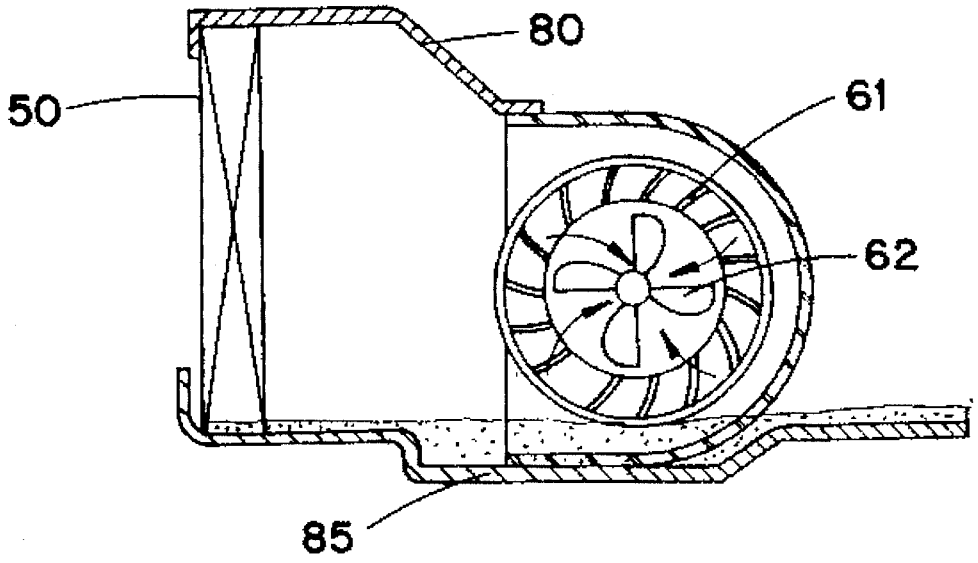
FIG. 7

WINDOW MOUNTED AIR CONDITIONER

BACKGROUND OF THE INVENTION

This invention relates to an air conditioner, more particularly, to a window mounted air conditioner in which the cooling efficiency is increased by modifying the configuration and arrangement of several components mounted in the housing.

SUMMARY OF THE PRIOR ART

A standard air conditioner is generally classified as either an integrated type or a split type according to the placement of the condenser and the compressor. In an integrated type air conditioner, the evaporator and the evaporator fan are placed in an interior location (i.e., an outdoor side) so as to cool the interior air, and a compressor, a condenser, and a condenser fan are placed in an exterior location (i.e., an outdoor side). The integrated type air conditioner is installed directly in a window or a wall of a building in such a manner that a portion of the air conditioner is located on the indoor side and the other portion is located on the outdoor side (Hereinafter called a window mounted air conditioner). Thus, the window mounted air conditioner is required to produce the highest possible cooling efficiency in as small space as possible.

In order to increase the cooling efficiency of a window mounted air conditioner, it is necessary for the indoor air which flows into the air conditioner to be fully heat-exchanged with the evaporator in order to be cooled to the desired low temperature, and then the cooled air to be emitted into the indoor space with a minimal amount of flow loss. To achieve this purpose, the capacities of the evaporator and the evaporator fan should be increased. But, in order to increase the capacities of the components, the overall size of the window mounted air conditioner must also necessarily be increased. Therefore, in order to minimize the size of a window mounted air conditioner, the size of each component located in the unit should be reduced, and consequently, the cooling capacity of the air conditioner is also decreased.

Further, the cooling efficiency of a window mounted air conditioner is lowered because in a window mounted air conditioner which is relatively smaller than a split type air conditioner, an air intake port for intaking the indoor air and an air discharge port for discharging the cooled air into the indoor space are structurally arranged close to each other so that a portion of the cooled air discharged into the indoor space through the air discharge port is, disadvantageously, directly recirculated into the air intake port.

On the other hand, the condenser located on the outdoor side of a window mounted air conditioner condenses the gas refrigerant into a liquid state utilizing the surrounding outdoor air and sends the refrigerant to the capillary tube. However, in order to increase the condensing capability, the capacity of the condenser and the condenser fan should be increased because the air conditioner is mainly used in high temperature settings or in summer when the temperature of the surrounding air is relatively high.

Accordingly, another method should be utilized to satisfy the aforementioned conditions for a window mounted air conditioner because its overall size should be as small as possible.

As a method for raising the cooling and condensing efficiencies without changing the size of the window mounted air conditioner, Japanese Utility Model Laid Open No. 63-63627 discloses an air conditioner in which the evaporator and the condenser are arranged in curved (i.e., generally L-shaped) formation, so that they not only occupy a smaller installation space, but also the unit has a larger heat-exchanging area.

Japanese Utility Model Laid Open No. 61-36219 discloses an air conditioner which has a fan housing enclosing a siroco fan in order to circulate a larger amount of the cooled air. Therefore, the cooling efficiency of such an air conditioner is increased.

A method for increasing the radiating efficiency of a condenser located on the outdoor side of a window mounted air conditioner is disclosed in Japanese Utility Model Laid Open No. 3-77118. This method utilizes the condensed water that is generated on the surface of the evaporator when the air conditioner is operated. That is, the condensed water is collected in the lower portion of a base plate, and due to the rotation of the condenser fan a slinger ring, which is attached to the circumferential surface of the condenser fan, sprinkles the condensed water onto the condenser. Accordingly, the radiating efficiency of the condenser is increased by the cooling action of the condensed water.

The methods according to the aforementioned prior art offer some advantages in that the cooling efficiency of a window mounted air conditioner is partly increased, but said methods can still be improved in order to further increase the cooling efficiency of a window mounted air conditioner.

For example, whereas the prior art according to Japanese Utility Model Laid Open No. 63-63627 positions the evaporator and condenser in an L-shape, the position of the air intake port for intaking the indoor air and the configuration of the evaporator fan are similar to those in a conventional air conditioner (see FIGS. 6 and 7 or that document), so that an enhancement of the overall cooling efficiency can not be expected.

The prior art according to Japanese Utility Model Laid Open No. 61-36219 has an advantage in that the indoor air is uniformly introduced into the evaporator by a spiral fan-housing, but further enhancement in the efficiency can not be expected, and also the fan-housing is only suitable for a split type air conditioner, not for a window mounted air conditioner to which this invention is adapted.

The prior art according to Japanese Utility Model Laid Open No. 3-77118 should be provided with an additional sprinkling device or slinger ring along the circumference surface of the propeller fan in order to sprinkle the condensed water on the condenser, and also the radiating effect by the condensed water is not fully achieved because the sprinkling direction of the condensed water by the rotation of the propeller fan is not correctly toward the condenser.

An object of this invention is to provide a window mounted air conditioner in which each component is formed in an efficient configuration and is efficiently arranged so as to effectively utilize the interior space of the air conditioner housing, thereby securing a sufficient cooling capacity.

Another object of this invention is to provide a window mounted air conditioner in which the air intake port for intaking the indoor air and the air discharge port for discharging the cooled indoor air are arranged as far away from each other as possible so that the cooled air is not directly re-circulated into the air intake port, thereby enhancing the cooling efficiency.

A further object of this invention is to provide a window mounted air conditioner which efficiently cools the indoor air introduced from the indoor area through the air intake port and which efficiently discharges it to the indoor area through the air discharge port, thereby further enhancing the cooling efficiency.

Yet another object of this invention is to provide a window mounted air conditioner which efficiently heat-exchanges the outdoor air in the condenser, thereby enhancing the radiating efficiency.

Another object of this invention is to provide a window mounted air conditioner which effectively sprinkles the condensed water, which is generated by the evaporator, onto the condenser, thereby further enhancing the radiating efficiency.

Other objects and advantages of this invention will be made apparent as the description progresses.

SUMMARY OF THE INVENTION

This invention has modified the configurations and installation positions of several components in a conventional window mounted air conditioner which comprises a front panel, an evaporator, an indoor fan, and an air filter, which are located on the indoor side of the unit, and a compressor, an outdoor fan, and a condenser, which are located on the outdoor side, in order to improve the overall efficiency of a window mounted air conditioner.

First, an air intake port for intaking the indoor air is formed in an L-shape going from a portion of the front panel on the indoor side to a side surface connected at a right angle to the front panel, and an air discharge port for discharging the cooled air into the indoor space is formed at the opposite portion of the front panel away from the air intake port, whereby the cooled air passing through the air discharge port is prevented from re-circulating again to the air intake port without being heat-exchanged with the indoor space.

The air filter which is positioned on the inside of the air intake port is also formed in an L-shape so as to correspond with the configuration of the air intake port. The air filter comprises a first filtering element for filtering the indoor air introduced through the front of the air intake port, a second filtering element for filtering the indoor air introduced through the side surface of the air intake port, a connecting element for rotatably connecting the first and second filtering elements, and a handle attached to the front of the connecting element. The first and second filtering elements are made of a material which can be flexibly bent and straightened in order that it can be conveniently inserted into and removed from the air intake port.

The evaporator which is arranged at the back of the air filter is formed in an L-shape so as to correspond with the configuration of the air intake port and the air filter, so that a larger amount of the indoor air can pass through the air intake port and be cooled.

The indoor fan, which forces the air cooled by the evaporator to be discharged into the indoor space through the air discharge port, is comprised of a siroco fan which is vertically installed in the interior side of the air conditioner. The indoor fan is positioned so that it is an equal distance from the two ends of the L-shaped evaporator so that the indoor air uniformly passes through the entire surface of the evaporator.

The window mounted air conditioner according to this invention further comprises an indoor air guide member located between the indoor fan and the air discharge port in order to effectively guide the cooled air discharged by the indoor fan into the indoor space with a minimal amount of flow loss.

On the other hand, in order to increase the radiating efficiency of the condenser which is located on the outdoor side, the outdoor fan comprises a horizontal shaft, a driving motor connected to one end of the horizontal shaft in order to rotate the horizontal shaft, a horizontal siroco fan positioned in the middle of the horizontal shaft, and a pair of propeller fans which are arranged on both sides of the horizontal siroco fan and which have a smaller diameter than that of the horizontal siroco fan. Accordingly, the inflow of the outdoor air is very effectively carried out by the combined rotation of the horizontal siroco fan and the propeller fans which are connected to a common driving shaft.

The condenser is formed in an L-shape and it is located at a rear corner of the outdoor side in the direction that the outdoor fan discharges the air so that the outdoor air intaked by the outdoor fan passes uniformly across the entire surface of the condenser.

In order for the outdoor air intaked by the outdoor fan to be very efficiently heat-exchanged with the condenser, the window mounted air conditioner of this invention further comprises an outdoor air guide member which encloses the outdoor fan and the condenser. The outdoor air guide member has both a pair of air inlets in order for a pair of propeller fans to intake the outdoor air, and also an outlet which is opened toward the L-shaped condenser.

A water container for receiving the condensed water generated by the evaporator located on the indoor side is installed under the outdoor fan, and thus by the rotation of the outdoor fan the blades of the horizontal siroco fan remove the condensed water from the water container and sprinkle it onto the condenser, so that the radiating efficiency of the condenser is further enhanced.

In the window mounted air conditioner of this invention as mentioned above, the indoor air passing through the evaporator and the refrigerant circulating in the interior of the condenser are very effectively cooled, and as a result, the window mounted air conditioner provides increased efficiency.

BRIEF DESCRIPTION OF THE DRAWINGS

In the accompanying drawings:

FIG. 6 is a sectional view taken along a line VI—VI shown in FIG. 1;

FIG. 7 is a sectional view taken along a line VII—VII shown in FIG. 6;

DESCRIPTION OF THE PREFERRED EMBODIMENTS

FIGS. 1 to 7 show a first embodiment of this invention.

Figure 1:
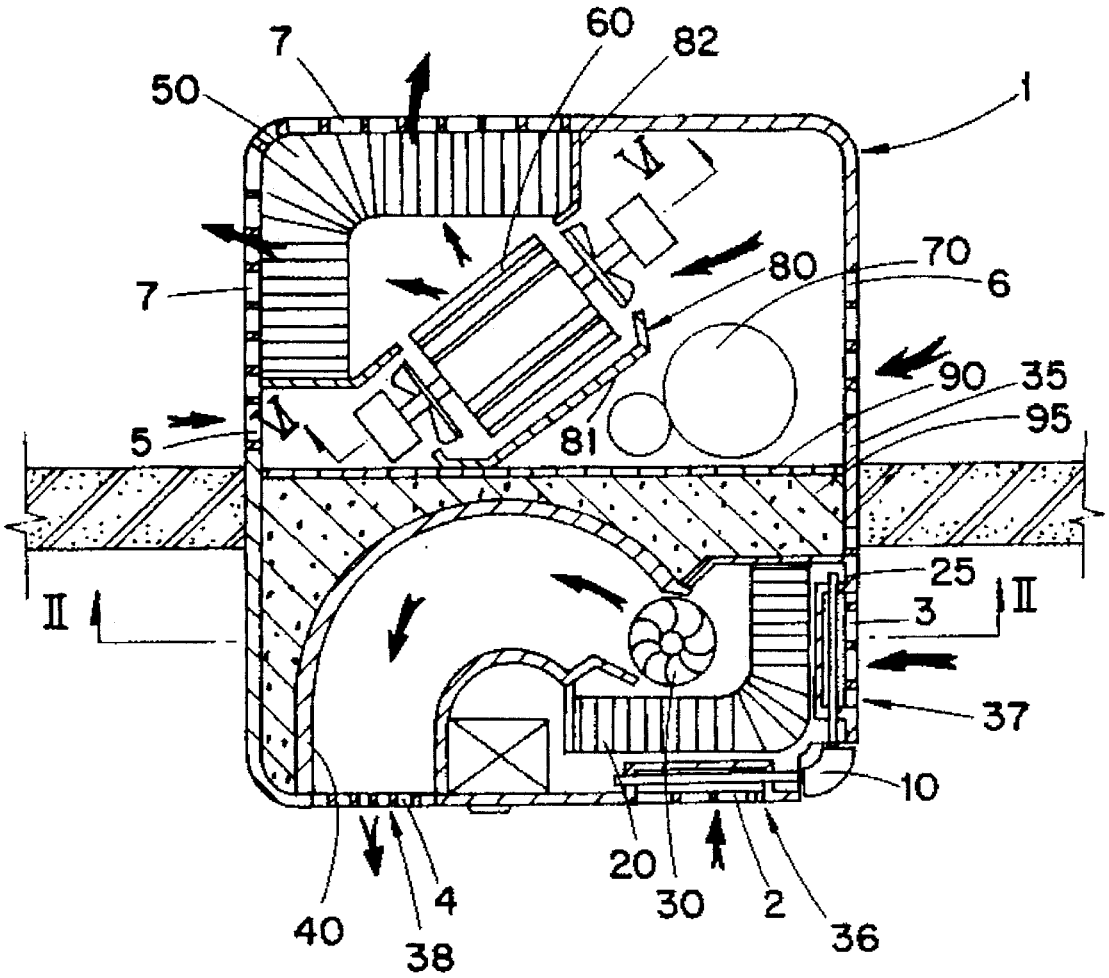
FIG. 1 is a sectional view of a window mounted air conditioner according to this invention.

As shown in FIG. 1, the integrated-type window mounted air conditioner to which this invention is adapted is divided into an indoor side 25 and an outdoor side 35 by a partition 90 transversely crossing the center of the main body 1. A soundproofing material 95 is inserted in the interior of the partition 90 so as to prevent noise generated in the outdoor side 35 from being transmitted to the indoor side 25.

An evaporator 20 for cooling the indoor air and an indoor fan 30 for discharging the cooled air into the indoor space are installed on the indoor side 25. A compressor 70, condenser 50, and an outdoor fan 60 are installed on the outdoor side 35.

Indoor air intake ports 2 and 3 for intaking the indoor air are formed in a portion 36 of the front panel of the indoor side 25 and on side surface or panel 37 adjacent to portion 36, respectively.

The evaporator 20 is formed in an L-shape as viewed in plan and is arranged at the corner of the indoor side 25 where the indoor air intake ports 2 and 3 are formed.

An air filter 10 for filtering foreign substances and dust is located between the indoor air intake ports 2, 3 and the evaporator 20.

An indoor air discharge port 4 for discharging the cooled air into the indoor space is formed in portion 38 of the front panel of the indoor side which is adjacent a corner opposite the corner at which the air intake ports 2 and 3 are located.

Figure 3:
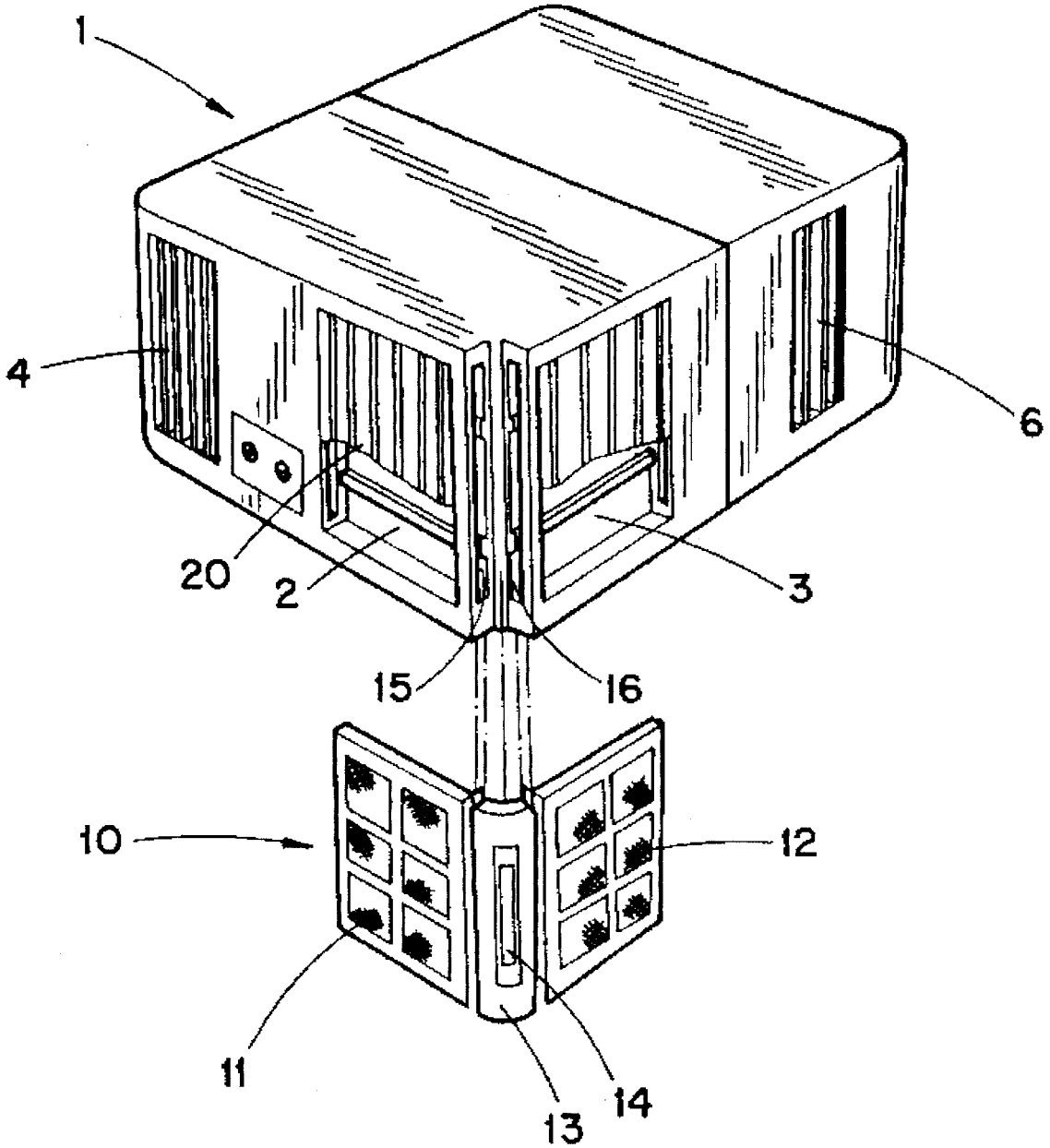
FIG. 3 is a perspective view showing an appearance of this invention.

As shown in FIG. 3, the air filter 10 comprises a first filtering element 11 which filters the indoor air introduced through the indoor air intake port 2, a second filtering element 12 which filters the indoor air introduced through the indoor air intake port 3, and a connecting element 13 which connects the first filtering element 11 with the second element 12.

The first and second filtering elements 11 and 12 are made of a flexible material so that they can be inserted into and removed from first and second grooves 15 and 16 which are formed at a right angle to each other on the inside of the indoor air intake ports 2 and 3.

The first and second filtering elements 11 and 12 can be turned around the connecting element 13 by means of hinges(not shown). Further, a handle 14 is provided on the front surface of the connecting element 13 to facilitate the air filter 10 being inserted into or removed from the first and second guide grooves 15 and 16.

The air filter 10 is inserted into the first and second guide grooves 15 and 16 as follows: the free end of the first filtering element 11 is placed in the first guide groove 15 and the free end of the second filtering element 12 is placed in the second guide groove 16, and then the handle 14 is used to push the air filter 10 toward the guide grooves 15 and 16. As a result, the first and second filtering elements 11 and 12 are easily inserted into the first and second guide grooves 15 and 16, respectively.

Conversely, in the event that the air filter 10 is removed from the first and second guide grooves 15 and 16, the handle 14 is slowly pulled, the air filter 10 is brought forward and the first and second filtering elements 11 and 12, which are made of a flexible material, are easily removed from the first and second guide grooves 15 and 16.

As described above, even though the L-shaped air filter 10 according to this invention contains two filters which are combined in one body and which are located at both sides of the main body 1, the filter 10 can be easily inserted into and removed from the main body 1, thereby facilitating easier maintenance and repair, and also improving the visual appearance of the window mounted air conditioner.

Further, the air intake ports 2 and 3 are located on two surfaces or panels of the main body 1 which are connected to each other at a right angle so that the window mounted air conditioner according to this invention utilizes a full air intaking area.

Additionally, while the evaporator 20 occupies only a small installation space, it has a larger surface area, because the evaporator 20 is formed in an L-shape that corresponds to the air intake ports 2 and 3. Accordingly, due to the features of this invention mentioned above, the window mounted air conditioner of this invention can cool a large amount of indoor air, and the indoor air intake and discharge ports 2, 3 and 4 can be located as far away from each other as possible.

Figure 2:
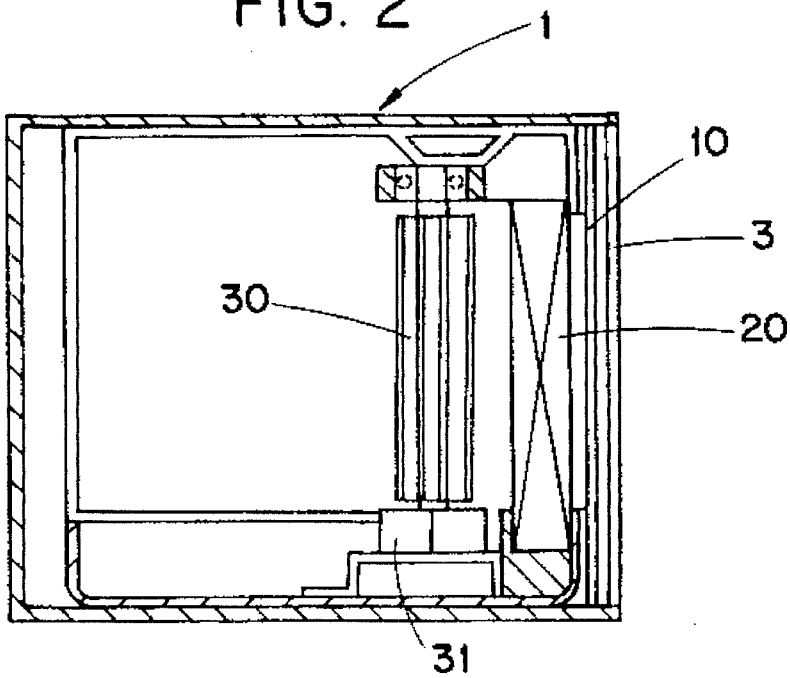
FIG. 2 is a sectional view taken along a line II—II shown in FIG. 1.

As shown in FIG. 2, the indoor fan 30, which is located at the back side (i.e., downstream side) of the evaporator 20, is comprised of a vertical siroco fan of a relatively small diameter, so that the indoor fan 30 not only can discharge a large amount of cooled air, but also it can occupy a smaller installation space than that of a conventional air conditioner.

It can be seen from FIG. 2 that the indoor fan 30 which is driven by a motor 31, which is located under the fan 30, has a large surface area so as to discharge a large amount of cooled air.

An indoor air guide member 40 is positioned between the indoor fan 30 and the indoor air discharge port 4 to efficiently guide the cooled air passing through the evaporator to the indoor space (Refer to FIG. 1).

Figure 4:
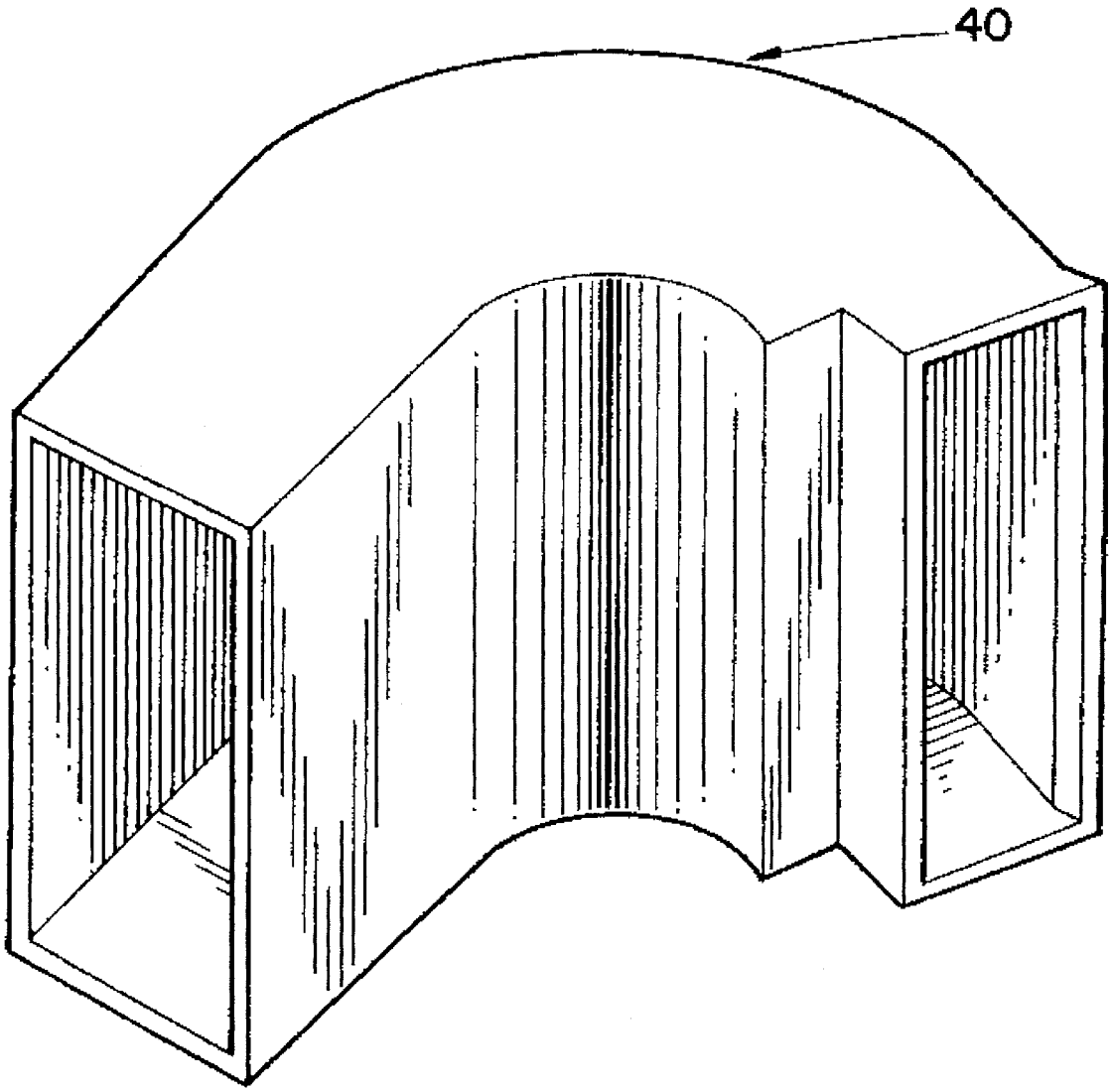
FIG. 4 is a perspective view showing an indoor air guide member.

As shown in FIG. 4 the indoor air guide member 40 is formed so that the cooled air passing through flows steadily and uniformly.

The condenser 50 which is located on the outdoor side 35, as shown in FIG. 1, condenses the gas refrigerant which flows inside the condenser 50 into a liquid state by heat-exchanging with the outdoor air. The outdoor air is introduced through outdoor air intake ports 5 and 6 which are formed in both side panels of the outdoor side 35, and the outdoor air which cools the condenser 50 is discharged to the outdoors through an L-shaped outdoor air discharge port 7, 7A formed at a rear corner of the outdoor side 35, i.e., discharge port 7 is formed in a side panel of the outdoor side 35, and the discharge port 7A is formed in a rear panel of the outdoor side.

The condenser 50, which is installed adjacent to the outdoor air discharge port 7, is formed in an L-shape corresponding to the shape of the outdoor air discharge port 7, 7A so that it provides a large surface area even though it occupies a small installation space, just as in the case of the evaporator 20.

As shown in FIG. 6, the outdoor fan 60, which is one of the characteristic portions in this invention, is installed obliquely at the front (i.e., upstream side) of the condenser 50 so as to effectively blow the outdoor air onto the L-shaped condenser 50. The outdoor fan 60 comprises a horizontal siroco fan 61 mounted on the middle of a horizontal shaft 64, a pair of propeller fans 62 mounted on both sides of the shaft 64, a driving motor 63 connected to one end of the shaft 64, and a supporting member 65 which is mounted on the other end of the shaft 64 and which rotatably supports the shaft 64. The diameter of the horizontal siroco fan 61 is larger than that of the propeller fans 62.

Therefore, when the horizontal shaft 64 is rotated by the operation of the driving motor 63, the siroco fan 61 and a pair of propeller fans 62 are rotated simultaneously. Accordingly, the outdoor fan 60 blows enough of the outdoor air toward the condenser 50 because the outdoor air is initially intaked by the propeller fans 62 arranged at both sides of the siroco fan 61, and then the outdoor air is supplied to the condenser 60 by the siroco fan 61. As a result, the function of the condenser 50 is very effectively performed.

In order to further increase the efficiency of the condenser 50, the window mounted air conditioner of this invention utilizes the condensed water generated on the outer surface of the evaporator 20.

That is, as shown in FIG. 7, a water container 85 is provided under the outdoor fan 60 to collect the condensed water, so the lower blades of the siroco fan 61 are submerged in the condensed water during the operation of the air conditioner.

When the outdoor fan 60 rotates, the siroco fan 61 sprinkles the condensed water, along with the outdoor air, onto the condenser 50, so the condenser 50 is air-cooled and water-cooled simultaneously.

Because a large amount of condensed water is generated in summer due to the high relative humidity, the window mounted air conditioner according to this invention has an additional benefit in that the condensed water is effectively utilized.

Figure 5:
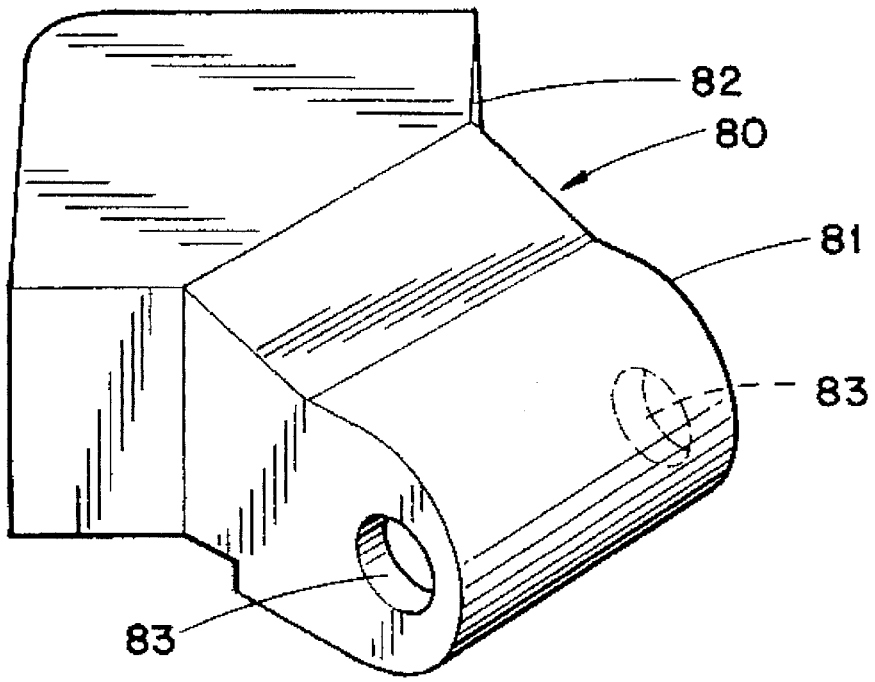
FIG. 5 is a perspective view showing an outdoor air guide member.

As shown in FIG. 5, the window mounted air conditioner according to this invention also has an outdoor air guide member 80 so that not only the outdoor air is directed to the condenser 50 with a minimal flow loss, but also the condensed water is not splashed into another area. The outdoor air guide member 80 comprises a front portion 81 which encloses the outdoor fan 60, and a rear portion 82 which encloses the condenser 50. Round openings 83 are formed at both sides of the front portion 81 to supply the propeller fans 62 with the outdoor air. The bottom of the outdoor air guide member 80 is also opened so that the siroco fan 61 sprinkles condensed water onto the condenser 50.

Figure 8:
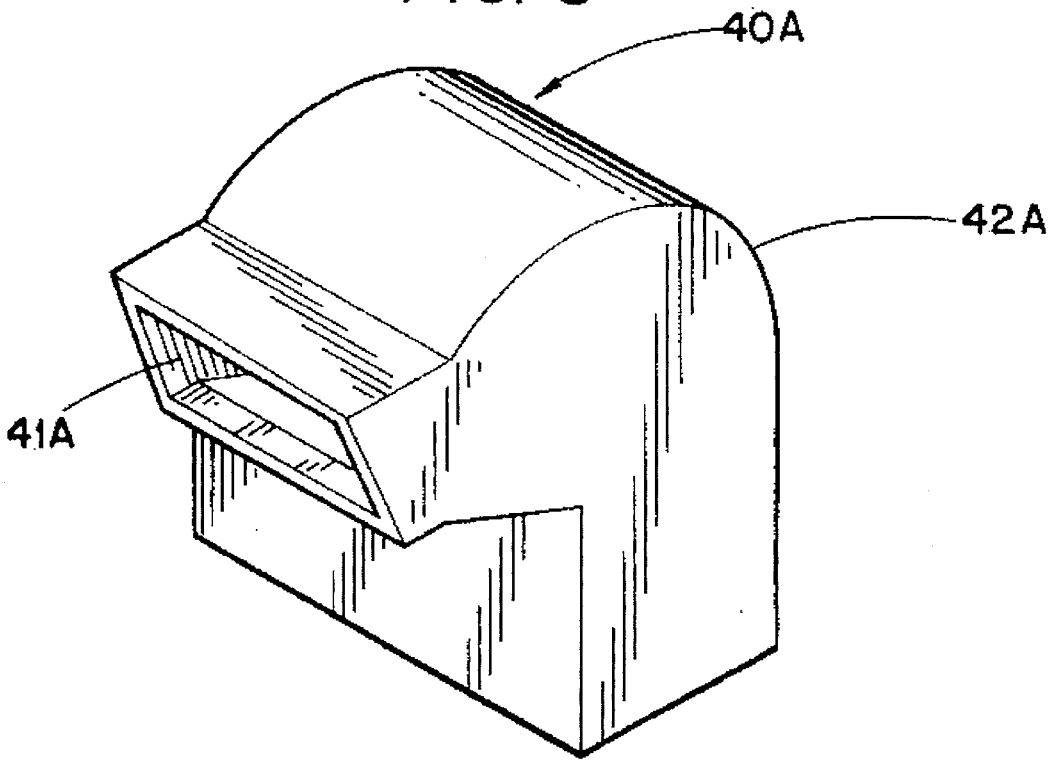
FIG. 8 is a perspective view showing another indoor air guide member according to another embodiment of this invention.
Figure 9:
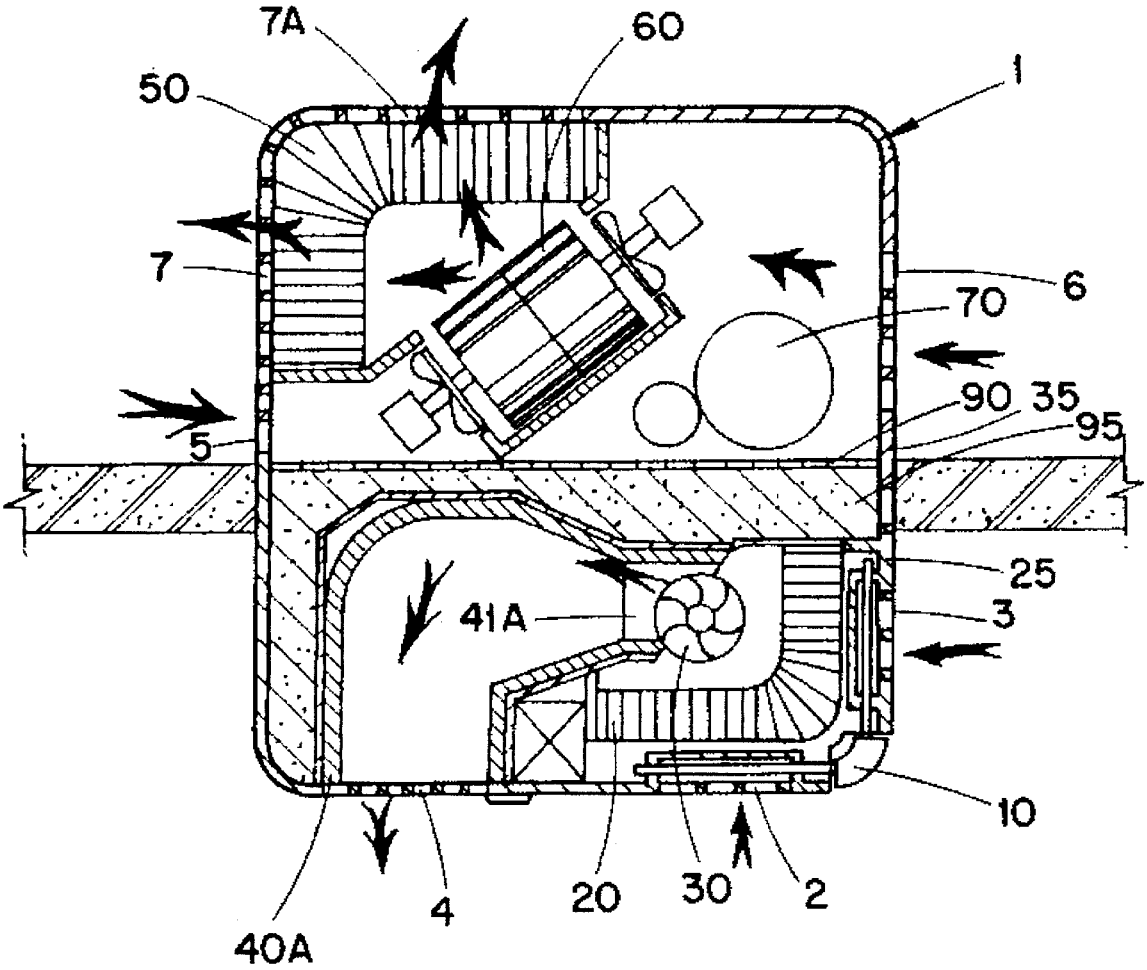
FIG. 9 is a sectional view of a window mounted air conditioner including the indoor air guide member shown in FIG. 8.

FIGS. 8 and 9 show a second embodiment of this invention.

As shown in FIG. 8, the configuration of the second embodiment is identical to that of the aforementioned first embodiment, except for an indoor air guide member 40A. An inlet 41A of the indoor air guide member 40A is somewhat long, and half of the vertical indoor fan 30 is inserted into the inlet 41A (Refer to FIG. 9).

A body 42A of the indoor air guide member 40A is formed at a right angle to the inlet 41A. Therefore, the cooled air passing through the evaporator 20 is more effectively directed into the indoor space by the indoor air guide member 40A.

As described above, the window mounted air conditioner according to this invention provides excellent performance because its mounted components are formed in efficient shapes and are arranged efficiently.

For example, the indoor air intake ports, the evaporator, and the air filter mounted therebetween are formed in an L-shape and are arranged at a front corner of the indoor side so that while they occupy only a small space in the inside of the air conditioner, a large amount of indoor air can be intaked and then be cooled by the unit.

Further, the manufacture and maintenance of the L-shaped air filter is very convenient because it is formed in one body and can be easily mounted on the air conditioner.

The radiating efficiency of the condenser is greatly improved, compared with a conventional window mounted air conditioner, due to the structural feature of the outdoor fan which comprises a siroco fan and a pair of propeller fans, which intake the outdoor air from the outside and discharge it into the condenser. The radiating efficiency of the condenser is further improved because the siroco fan sprinkles the condensed water generated by the evaporator onto the condenser.

Especially, the cooling efficiency of the window mounted air conditioner according to this invention is further improved because the indoor air discharge port is arranged as far away as possible from the indoor air intake ports so that any cooled air leaving the indoor air discharge port is prevented from being directly recirculated into the indoor air intake ports.

In addition, the cooling efficiency of the window mounted air conditioner according to this invention is further improved by the air guide members which effectively guide the indoor and outdoor air therethrough with minimal flow loss.

What is claimed is:

1. A window air conditioner, comprising:

a housing having indoor and outdoor portions separated by a partition;

a compressor, an outdoor fan, and a condenser disposed in said outdoor portion; said indoor portion including a front panel and a pair of side panels connected to opposite ends of said front panel, side intake ports formed in one of said side panels, and front intake panels formed in said front panel adjacent an end thereof intersecting said one side panel, said indoor portion further comprising a discharge port arranged remote from said front and side intake ports;

an evaporator disposed in said indoor portion and comprising first and second sections arranged in a general L-shape, said first section arranged across said front intake ports; and said second section arranged across said side intake ports; and an indoor fan arranged within said indoor portion at a location downstream of said front and side intake ports and rotatable about a vertical axis for drawing air inwardly through said front and side intake ports and then through said first and second evaporator sections and then directing such air toward said discharge port;

said outdoor portion including a rear panel and a pair of side panels connected to said rear panel, air intake ports being formed in both side panels of said outdoor portion, air discharge ports being formed in said rear panel and in one of said side panels of said outdoor portion, said condenser including first and second sections arranged in a general L-shape, said first section of said condenser extending across said discharge port of said rear panel, and said second section of said condenser extending across said discharge port of said one side panel of said outdoor portion, said outdoor fan arranged in said outdoor portion for effecting an air circulation to said condenser from said intake ports of said rear panel and said one side panel.

2. The window air conditioner according to claim 1, further including a flexible filter having a first side facing said front and side intake ports, and a second side facing said first and second evaporator sections, said flexible filter being bent into an L-shape and situated opposite said front and side intake ports; said indoor fan being rotatable about a vertical axis; said outdoor fan being rotatable about a horizontal axis and including a central portion and a pair of end portions disposed adjacent respective ends of said central portion, said end portions configured to direct air toward said central portion, and said central portion configured to direct air toward said condenser.

3. The window air conditioner according to claim 2 wherein said housing forms a water container in said outdoor portion for collecting water condensed by said condenser; said central portion being of greater diameter than said end portions and projecting into said water container for transferring water onto said condenser.

4. The window air conditioner according to claim 2 wherein said first and second sections of said condenser intersect one another at a corner of said outdoor section; said outdoor fan arranged to discharge air directly toward said corner.

* * * * *